United States Patent [19]

Schwartz

[11] 4,351,691

[45] Sep. 28, 1982

[54] APPARATUS FOR MAKING A TUFTED PRODUCT

[76] Inventor: Jack M. Schwartz, Rte. 1, Fairmont, Ga. 30755

[21] Appl. No.: 209,735

[22] Filed: Nov. 24, 1980

[51] Int. Cl.[3] ..... D04H 11/00

[52] U.S. Cl. ..... 156/435; 156/72; 226/199

[58] Field of Search ..... 156/435, 72; 28/2 M, 28/215, 216, 172, 202, 203; 242/157 R; 226/199, 196; 83/909; 139/7 A, 10; 112/79 A, 79 R

[56] References Cited

U.S. PATENT DOCUMENTS

| | | | |
|---|---|---|---|
| 3,580,761 | 5/1971 | Boultinghouse | 156/72 |
| 3,839,114 | 10/1974 | Schmidt et al. | 156/72 |
| 3,878,011 | 4/1975 | Currell et al. | 156/72 |
| 3,937,643 | 2/1976 | Spanel | 156/435 |
| 3,944,451 | 3/1976 | Partensky | 156/72 |

*Primary Examiner*—Michael W. Ball

*Attorney, Agent, or Firm*—Jones & Askew

[57] ABSTRACT

Apparatus for producing tufted carpet by precutting yarn into individual tufts, and pressing the tufts into an adhesive coating on a backing material. Individual yarns are selectably clamped on a sliding bed, and the sliding bed is moved forwardly to a tufting position. Forward movement of the bed withdraws the yarns and cuts the withdrawn yarns to desired length. The yarns are then unclamped, and a tufting bar passes through aligned secondary and primary tufting slots to press the cut yarns against the backing material. The yarns are supplied through a yarn pattern head having a number of yarn bars individually and selectably positionable to vary the tufting pattern in any predetermined manner.

10 Claims, 10 Drawing Figures

APPARATUS FOR MAKING A TUFTED PRODUCT

BACKGROUND OF THE INVENTION

This invention relates to apparatus for making tufted products such as carpet or the like, and more particularly relates to apparatus particularly useful for producing cut pile patterned carpets.

Prior art apparatus for producing tufted carpet is known to the art. One such process of the art, known as "fusion bonding", calls for bonding yarn tufts between two face-to-face sheets of backing material. The yarn is then split into two parts midway between the two backing sheets, producing two separate mirror-image carpets. Other prior art techniques for making tufted carpet require individual tuft gripping members for holding each cut tuft of carpet yarn. An example is shown in U.S. Pat. No. 3,878,011 to Currell et al. That carpet tufting apparatus is complex in design and operation, and is not suited to manufacture patterned tufted carpets.

Still other apparatus of the prior art is shown in U.S. Pat. No. 3,937,643 to Spanel, wherein individual yarns are first secured to a carpet backing before cutting. The secured yarns are then cut from the yarn supply to create individual tufts, after which the process is repeated. This kind of tufting machine also is not suited to producing patterned tufted carpets.

SUMMARY OF INVENTION

Tufted carpet is produced according to the apparatus of the present invention by dispensing and clamping yarn strands in a selected variable array, precutting the yarn into individual tufts, and pressing these tufts into an adhesive coating on a backing material. Stated somewhat more particularly, the apparatus of the present invention includes a yarn feed head which is positioned to present a selected array of individual yarns to a yarn clamping apparatus. The yarn clamping apparatus is mounted on a movable bed which, after clamping a selected array of yarns, moves toward a tufting position adjacent an adhesive-coated carpet backing. The clamped yarn strands are pulled between fixed and movable cutting edges as the bed moves toward the tufting position, causing individual yarn strands of predetermined length to be cut. The yarn clamp opens as the movable bed is positioned at the tufting location, and a tufting blade engages and pushes the cut yarn tufts onto the backing material.

The yarn feed head of the present invention includes a number of individual yarn tubes carried by a lesser number of separate movable yarn bars. These yarn bars are positioned above the yarn clamping apparatus of the movable bed, and the yarn bars can be shifted sideways relative to the longitudinal extent of the carpet backing material. Shifting the position of a yarn bar produces a corresponding shift in position of the yarn tubes associated with the yarn bar, and thus shifts the position of the yarn tufts supplied to the backing material from the yarn tubes. The yarn feed head can be positioned to supply yarns from two yarn bars simultaneously, and each such yarn bar can be individually shifted in a cyclic manner, thus giving the capability to produce a wide range of predetermined multi-colored patterns on the resulting tufted carpet product.

Accordingly, it is an object of the present invention to provide improved apparatus for making tufted products such as carpet or the like.

It is another object of the present invention to provide tufting apparatus especially useful for producing patterned carpet.

The foregoing and other objects and advantages of the present invention will become more readily apparent from the following discussion of the disclosed preferred embodiment.

DESCRIPTION OF PREFERRED EMBODIMENT

Figure 1:
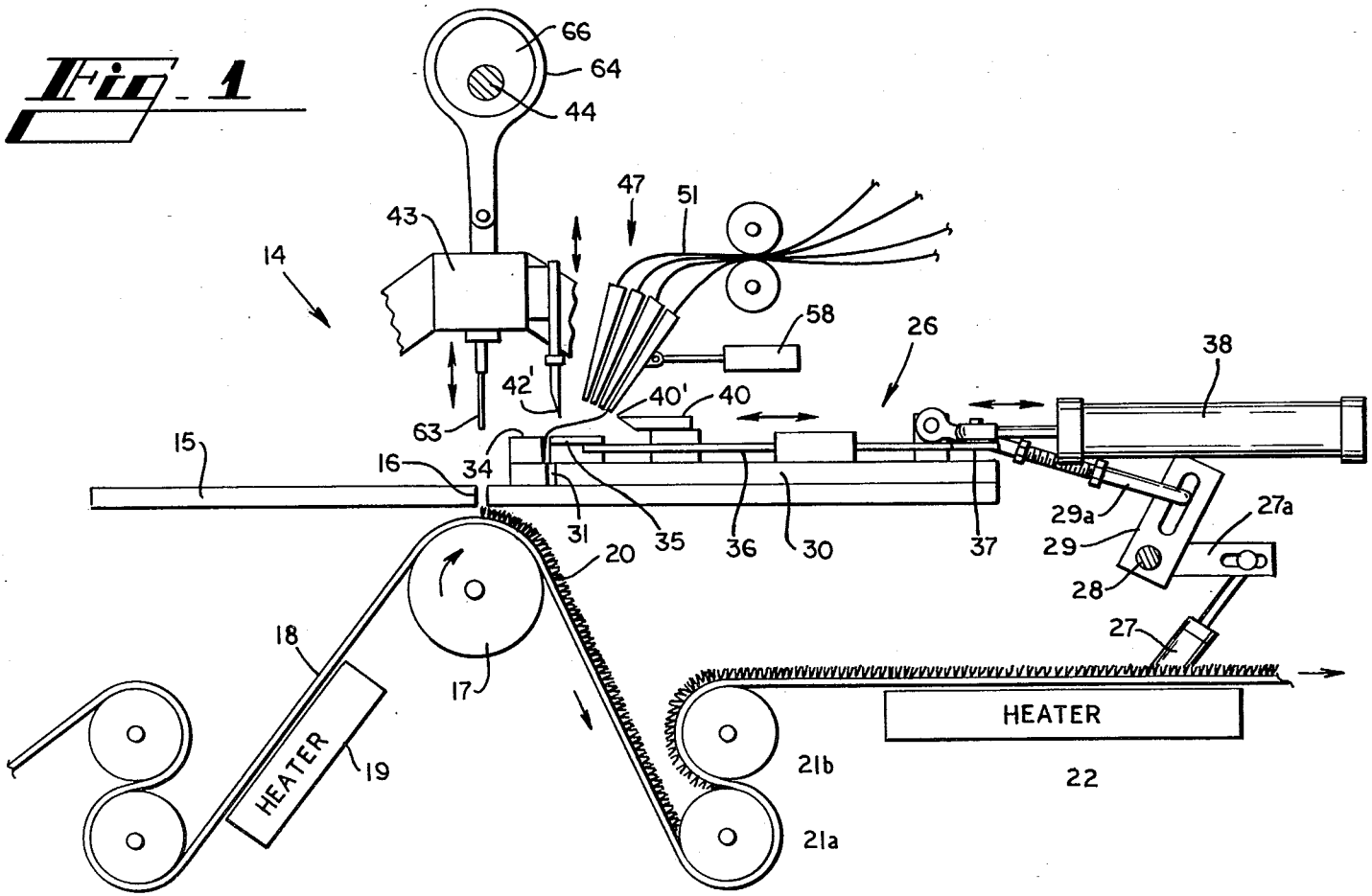
FIG. 1 shows a side elevation view of a carpet tufting apparatus according to the disclosed embodiment of the present invention.

The present tufting apparatus according to the disclosed embodiment is shown generally at 14 in FIG. 1. This tufting apparatus includes a fixed bed 15 best seen in FIG. 6, and extending at least the width of a carpet or other product to be tufted. A primary tufting slot 16 is formed in the fixed bed 15, extending substantially the full width of the bed plate 30.

Disposed beneath the fixed bed 15 adjacent the primary tufting slot 16 is the backing roller 17, which is axially aligned with the primary tufting slot. The backing roller 17 supports the carpet backing material 18, which is supplied to the backing roller after passing in proximity to the primary heater 19. The backing material 18, after receiving yarn tufts 20 as described below, passes over additional rollers **21*a* and 21*b*, and then passes over a secondary heater 22** which heats the underside of the backing material.

The carpet backing material 18 is preferably precoated with a suitable adhesive such as a hot melt compound, and the nature and composition of such adhesives are known to those skilled in the art. As the precoated backing material passes over the primary heater 19, the adhesive coating is warmed sufficiently to become tacky. The backing material then passes over the backing roller 17 to receive the cut yarn tufts as described below. After the yarn tufts are set into the tacky adhesive, the backing material then passes over the secondary heater 22 which heats the adhesive sufficiently to provide permanent and maximum binding of the tufts onto the backing material.

Figure 3:
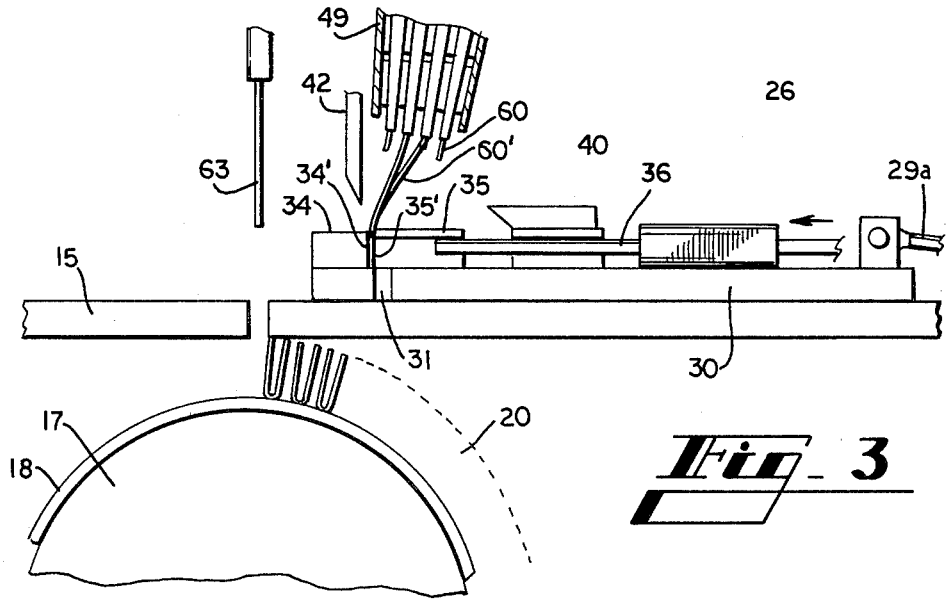
Figure 4:
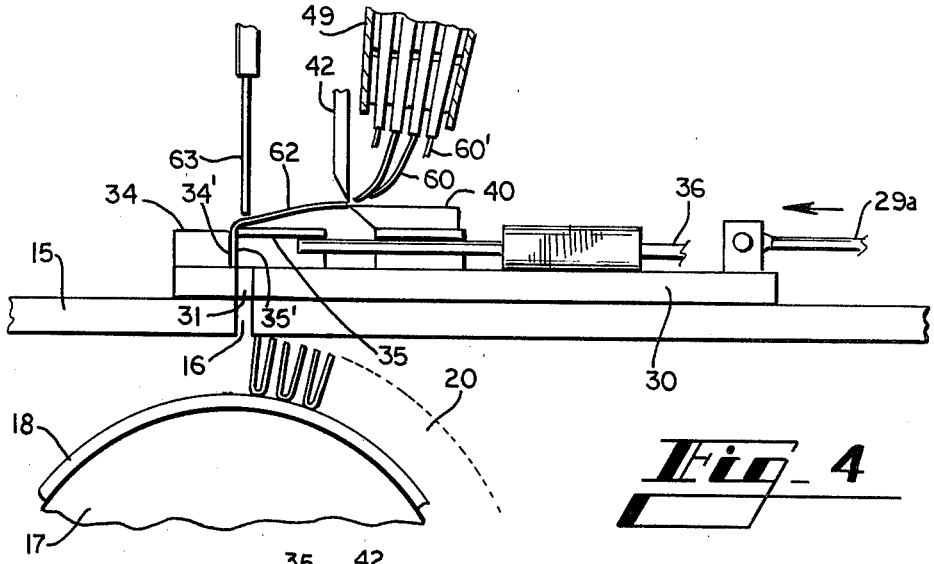

Disposed on the fixed bed 15 to the right (as seen in FIG. 1) of the primary tufting slot 16 is the sliding bed 26, which is suitably supported for sliding movement along the stationary bed 15 on a path transverse to the length of the primary tufting slot 16. The position of the sliding bed 26 on the fixed bed 15 is determined by the double-action air cylinder 27, which is connected by a first crank arm 27*a* to rotate the crank shaft 28 (FIG. 6). The shaft 28, in turn, is connected through a pair of second crank arms 29*a* to the sliding bed 26. The sliding bed 26 is shown in its backward or fully-retracted position in FIG. 2, and in its forward or fully-extended position in FIG. 5. FIGS. 3 and 4 depict intermediate positions of the sliding bed 26.

The sliding bed 26 includes a bed plate 30 disposed in substantially parallel sliding alignment on the fixed bed 15, and a secondary tufting slot 31 is formed in the bed plate. The width of the secondary tufting slot 31 is preferably substantially the same as that of the primary tufting slot 16, and the length of the secondary tufting slot is at least as great as the width of the backing material 18 being tufted.

A fixed clamp bar 34 is mounted on the sliding bed 26 immediately in front of the secondary tufting slot 31. This fixed clamp bar has a substantially flat yarn clamping surface 34' running along at least the length of the secondary tufting slot 31, and extending perpendicularly outwardly from the bed plate 30 of the sliding bed 26.

Extending along the other side of the secondary tufting slot 31 is the movable clamp bar 35, having a yarn clamping surface 35' running the length of the secondary tufting slot and facing the clamping surface 34' of the fixed clamp bar. A number of connecting links 36 extend backwardly from the movable clamp bar 35 and connect to the operating bar 37, which is in turn coupled to the piston rod of a double-action air cylinder 38 mounted on the sliding bed 26. The air cylinder 38 is carried by the sliding bed 26 by a mounting plate not shown in FIG. 1, and is shown in its retracted position in FIG. 6 with the movable clamp bar 35 maintained in open position. When the clamp air cylinder 38 is extended, the operating bar 37 and connecting links 36 move forwardly to drive the movable clamp bar 36 into clamping position, with the clamping surface 35' pressed tightly against the clamping surface 34' of the fixed clamp bar 34.

A movable cutter bar 40, coextensive with the length of the secondary tufting slot 31, is mounted on the sliding bed 26 immediately behind the movable clamp bar 35 in its fully-retracted position shown in FIG. 6. The movable cutter bar 40 is fixed to the sliding bed 26, and actually is "movable" only relative to stationary objects such as the fixed bed 15. The movable cutter blade 40 has a cutting or shearing edge 40' facing the secondary tufting slot 31, as best seen in FIGS. 1 and 6.

The movable cutter blade 40 is positioned on the sliding bed 26 to undergo cutting or shearing interaction with the cutting edge 42' of the fixed cutter blade 42, FIG. 1. This fixed cutter blade is mounted on the frame member 43, fragmentarily shown in FIG. 1, which extends transversely across the fixed bed 15 and which also provides a stationary support (not shown) for the rotatable main cam shaft 44 mounted in parallel alignment with the primary tufting slot 16. The fixed cutter blade 42 is preferably adjustable in elevation, so as to insure the proper shearing relation as the movable cutter bar 40 passes beneath the fixed cutter bar in response to forward movement of the sliding bed 26.

Figure 2:
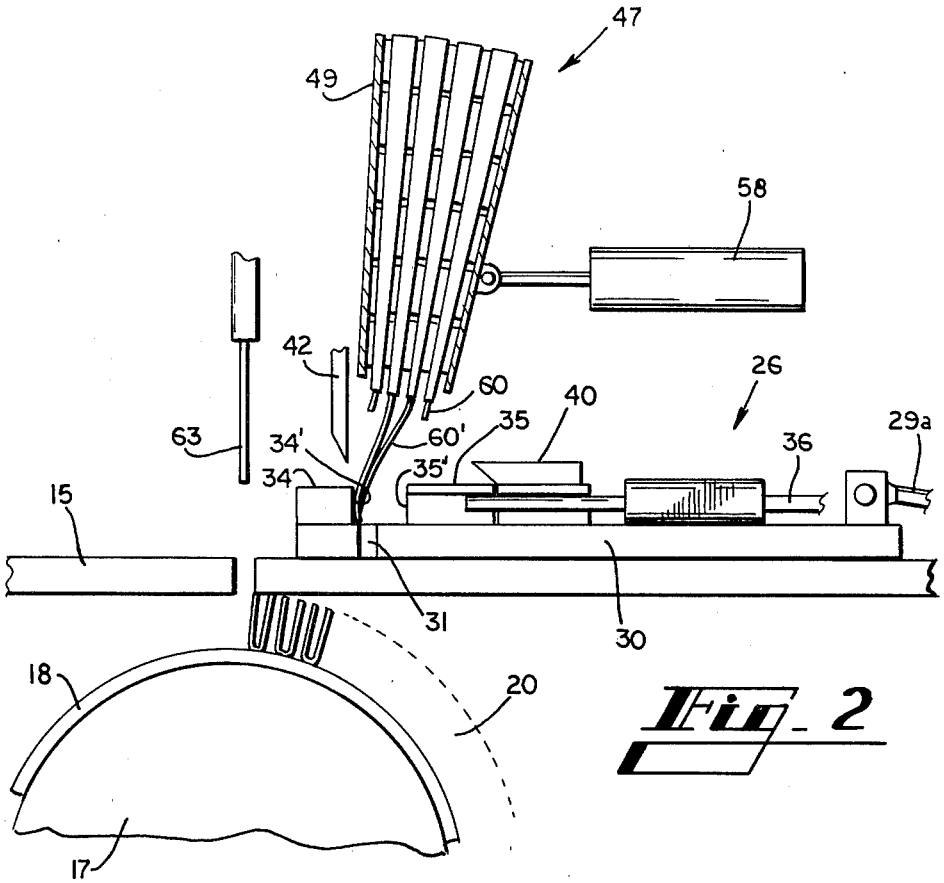
FIGS. 2–5 show detailed fragmentary views of the tufting apparatus in FIG. 1, at several progressive steps in a tufting cycle.
Figure 7:
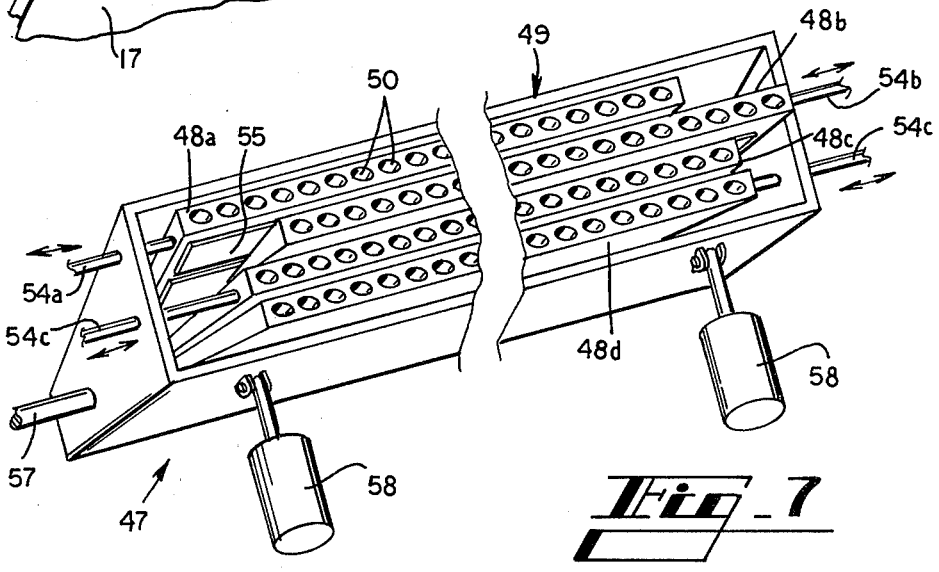
FIG. 7 shows a partial pictorial view of the yarn feed head in the disclosed embodiment.
Figures 8, 9:
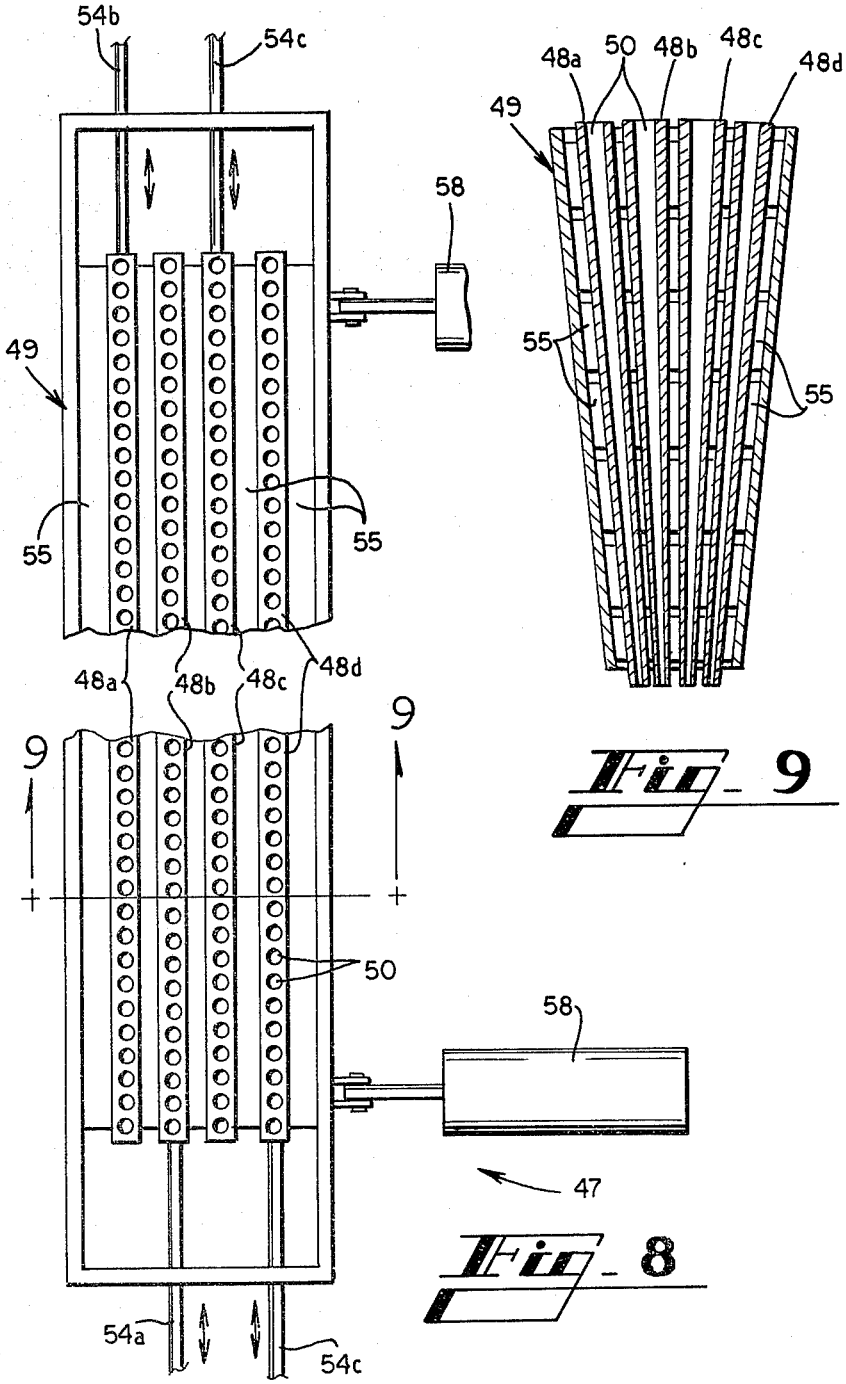
FIG. 8 shows a plan view of the yarn feed head shown in FIG. 7.
FIG. 9 is a section view taken along line 9—9 of FIG. 8.

Located above the sliding bed 26 is the yarn pattern head assembly 47 best seen in FIGS. 1 and 2 with the remainder of the tufting apparatus 14, and separately shown in FIGS. 7–9. The yarn pattern head 47 presents to the sliding bed 26 an array of yarns bearing a predetermined relation to each other, but which may be spatially shifted with respect to the backing material 18 being tufted. To accomplish that purpose, the yarn pattern head 47 includes a number of individual yarn headers or bars 48*a*, 48*b*, 48*c*, 48*d*, each of which is contained within a header carrier 49 mounted above the sliding bed 26 of the tufting apparatus. Each of the yarn bars 48*a*–48*d* has a number of individual yarn receiving tubes collective denoted at 50, and each tube receives a separate strand of yarn 51 (collectively shown in FIG. 1) from a suitable supply. The yarn receiving tubes 50 may be equipped with conventional one-way feed control devices to prevent the yarns 51 from being withdrawn upwardly out of the tubes.

The header carrier 49 is substantially longer than each of the yarn bars 48*a*–48*d* as best seen in FIG. 8, and the yarn bars are supported in the header carrier for individual reciprocal movement relative to each other and relative to the header carrier. The overall length of each yarn bar 48*a*–48*d* should be somewhat longer than the width of the backing material 18 being tufted, so that the width of the backing material is covered by each yarn bar at either extremity of its possible reciprocal movement.

Each yarn bar 48*a*–48*d* is mechanically linked to a corresponding control rod 54*a*–54*d* extending through the ends of the header carrier, and these control rods are individually and selectably adjusted to select the lateral positions of the yarn bars in a manner described below. The yarn bars are preferably separated from each other and from the sides of the header carrier by spacer members 55 (FIGS. 8 and 9) which maintain a desired predetermined lateral separation between adjacent yarn bars, and which also support the yarn bars for ease of sliding movement within the header carrier. As also seen in FIG. 9, the individual yarn bars 48*a*–48*d* are mounted within the header carrier 49 in a converging-plane arrangement which aims the yarn receiving tubes 50 toward a point of convergence at some location below the yarn pattern head 47.

The header carrier 49 is mounted above the sliding bed 26 on a pair of support members, one of which is shown at 57 in FIG. 7. The rocking position of the header carrier 47 about the support 57 is determined by a pair of control solenoids 58, and it will become apparent that the solenoid-controlled rocking position of the header carrier determines the individual yarn bars 48*a*–48*d* which are operatively in yarn dispensing position with regard to the sliding bed 26. In any selected rocking position of the header carrier 47, moreover, the lateral position of each yarn bar is individually changeable by actuation of the appropriate control rod 54*a*–54*d* associated with that yarn bar.

The operation of the tufting apparatus is now described with particular reference to FIGS. 2–5. Turning first to FIG. 2, the sliding bed 26 is initially assumed to be in its backward or fully-retracted position and the movable clamp bar 35 is retracted to its full-open position. The yarn pattern head 47 is located so that the yarn ends 60 extending downwardly from the yarn pattern head are generally aligned with the open region between the fixed clamp bar 34 and the movable clamp bar 35. With the yarn bar header carrier 49 appropriately positioned by the control solenoids 58, yarns 60' from any two adjacent yarn bars can be extended downwardly from the yarn pattern head 47 and initially placed between the opposing faces of the two clamp bars, a condition illustrated in FIG. 2.

With the apparatus positioned as thus described, a tufting cycle begins by actuating the clamp air cylinder 38 to drive the movable clamp bar 35 forwardly into clamping engagement with the fixed clamp bar 34. The selected yarn ends 60' are now firmly engaged between the two clamp bars, as shown in FIG. 3.

Figure 5:
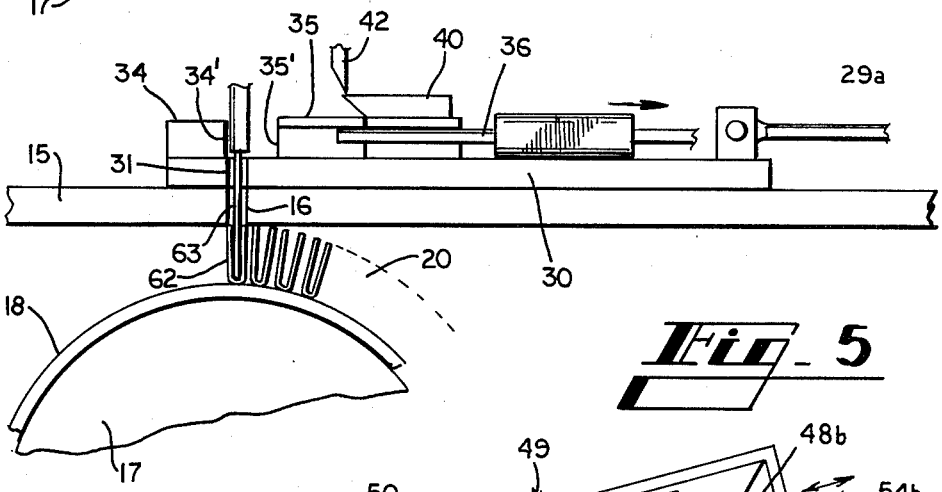
Figure 6:
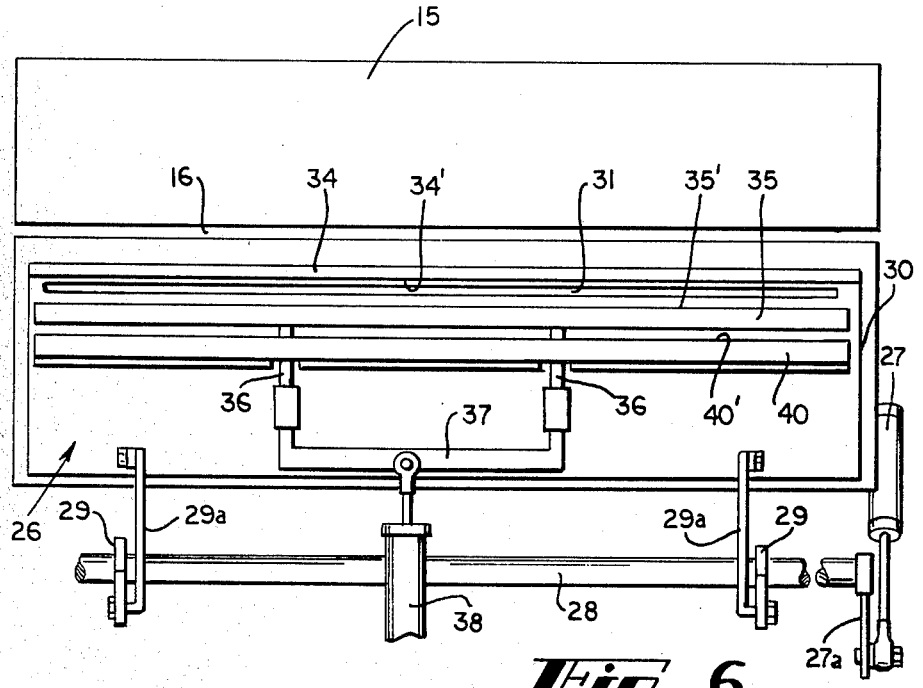
FIG. 6 shows a fragmentary plan view of the sliding bed and clamp assembly in the disclosed embodiment, with the yarn feed apparatus removed for clarity.

With the yarn ends 60' firmly clamped on the sliding bed 26, the air cylinder 27 is activated to drive the sliding bed forwardly toward the tufting position illustrated in FIGS. 4 and 5. This forward movement of the sliding bed 26 causes the selected yarn strands 60' to be further withdrawn from the yarn pattern head 47, and also brings the movable cutter bar 40 into cutting alignment with the fixed cutter bar 42. This cutting alignment is shown at FIG. 4, where the forward movement of the sliding bed 26 is completed. It can be seen that the selected yarn strands 60' have been cut at this time, leaving a row of cut yarn tufts 62 clamped between the fixed clamp bar 34 and the movable clamp bar 35 along the lengthof the clamp bars. It can also be seen that the secondary tufting slot 31 of the sliding bed 26 is now aligned with the primary tufting slot 16 of the fixed bed.

The movable clamp bar 35 is now retracted by operation of the air cylinder 38, releasing the cut yarn tufts 62 and allowing these yarn tufts to lie across the secondary tufting slot 31. At this time, the tufting blade 63 descends through the aligned secondary and primary tufting slots, engaging the released yarn tufts 60 and pushing the cut yarn tufts downwardly through the aligned tufting slots into contact with the adhesive-coated backing material 18 located below the primary tufting slot. Each yarn tuft 62 is folded into an approximate V-shaped by passage of the tufting blade 63 through the primary and secondary tufting slots, as seen in FIG. 5, so that each cut tuft of yarn provides a pair of tuft ends standing out from the backing material 18. The tufting blade 63 is now retracted upwardly through the aligned slots, returning to its normal raised position shown in FIG. 1, after which the air cylinder 27 is actuated to return the sliding bed 26 to its backward position. A complete tufting cycle has now been completed, and the remaining free yarn ends 60' are in position above the open clamp bars for another tufting cycle.

The tufting blade 63 is raised and lowered by means of a yoke 64 driven by a tufting cam 66 driven by the main cam shaft 44 mounted above the frame 43. The construction and operation of the tufting blade per se is conventional, and is not described herein in further detail.

Figure 10:
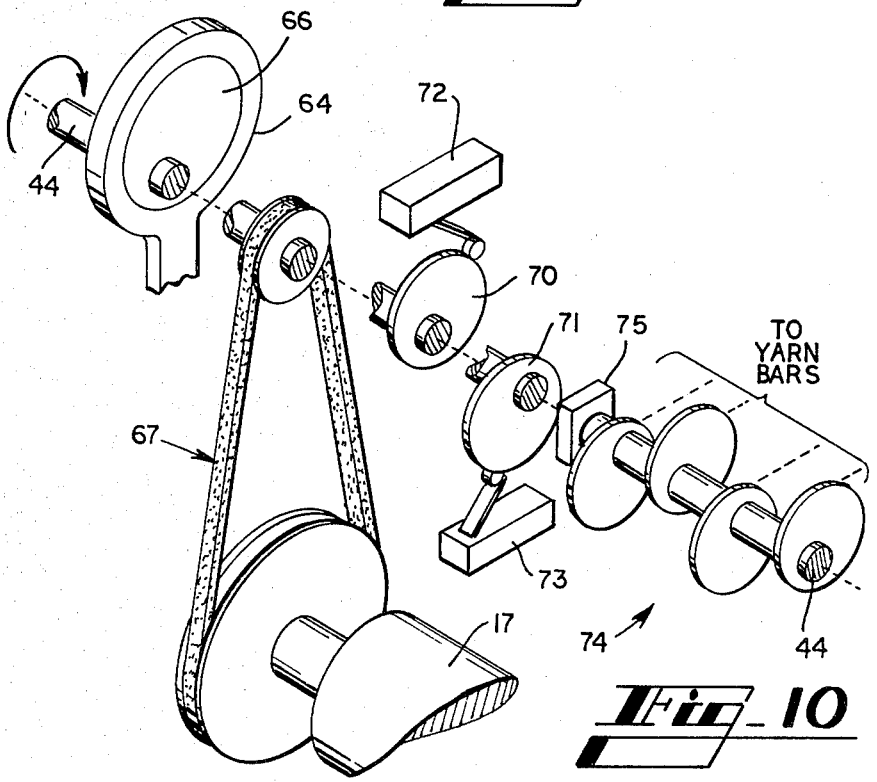
FIG. 10 is a schematic view illustrating the mechanical drive and control system of the disclosed embodiment.

FIG. 10 schematically depicts a mechanism for driving the present tufting apparatus through the foregoing operational sequence. The main cam shaft 44 is coupled to a prime mover through a suitable speed reducer to drive the main cam shaft at the desired speed, and that cam shaft operates the tufting blade through the yoke 64 as noted above. The main cam shaft is also coupled through a speed reduction drive 67 to rotate the backing roller 17, and it should be understood that the additional carpet backing support rollers depicted in FIG. 1 are preferably coupled to be driven in synchronism with the roller 17. The reduction drive 67 is preferably a variable-speed reduction drive, so that the tufting density (the number of rows of tufts per lineal inch of carpet backing) may be varied by adjusting the speed of the backing roller 17.

The main cam shaft 44 also drives the bed control cam 70 and the clamp control cam 71, along with the yarn bar cams collectively designated 74. The bed control cam 70 actuates the bed air valve 72, which supplies operating air to the double-action air cylinder 27 for advancing or retracting the sliding bed 26. The clamp control cam 71 likewise controls operation of the clamp air cylinder 38 through the clamp control valve 73. In this way, the above-described operating sequence of the present tufting apparatus is readily synchronized with the mechanical operation of the tufting blade.

Each of the yarn bar cams 74 is mechanically interconnected with a corresponding one of the control rods **54*a*–54*d*, for varying the lateral positions of the yarn bars within the yarn pattern head as described above. The yarn bar cams 74 can be driven through a reduction drive 75 if desired, so that the tufting pattern may be varied at a selectable rate relative to the forward movement of the carpet backing material 18**.

The tufting density may be adjusted by varying the speed of the backing material 18, as mentioned previously, and the length of each individual tuft may be changed by adjusting the stroke distance of the sliding bed 26 between its full-backward position and the yarn shearing position. Adjusting the stroke of the sliding bed can be accomplished by adjusting the length of the crank arms **29*a*, and effectively varies the amount of yarn withdrawn from the yarn pattern head 47** during forward movement of the sliding bed.

It can be seen from the foregoing that the present improved tufting apparatus cuts and sets yarn tufts without passing the yarn through individual needles or hooks which cannot readily be shifted in position. Different colored yarns may be fed to each yarn bar in any desired sequence, and the tufting pattern produced by those yarns is variable at will depending on the direction and extent the selected yarn bar is moved within the yarn pattern head. Although cams driven by the main shaft are illustrated to drive the yarn bars, it will be understood that alternative drive mechanisms may be substituted for producing desired tufting patterns.

It should also be understood that the foregoing relates only to a preferred embodiment of the present invention, and that numerous changes and modifications may be made therein without departing from the spirit and scope of the invention as defined in the following claims.

I claim:

1. Apparatus for producing tufted material, comprising:

a stationary bed;

an elongated primary tufting slot extending through said stationary bed;

means disposed adjacent one side of said stationary bed to support a tuft receiving backing material in proximate relation to said primary tufting slot;

a sliding bed disposed on the other side of said stationary bed, and selectably movable either to a forward position or a backward position relative to the stationary bed;

an elongated secondary tufting slot extending through said sliding bed, said secondary tufting slot being parallel to said primary tufting slot and being in overlying alignment with the primary tufting slot whenever said sliding bed is in said forward position;

yarn dispensing means disposed adjacent said sliding bed and operative to present plural strands of yarn to the sliding bed at a position spaced apart from said forward position;

yarn clamp means carried on said sliding bed and selectably operative at said spaced apart position to engage and hold said yarn strands, so that lengths of the yarn strands are withdrawn from said yarn dispensing means as said sliding bed moves toward said forward position;

cutting means movable with said sliding bed and operative in response to movement of said sliding bed toward said forward position to cut off a predetermined length of said withdrawn yarn strands, so that the cut lengths of yarn remain engaged by said clamp means and are carried to the forward position with the sliding bed;

said clamp means being operative to release said cut lengths of yarn when said sliding bed is at said forward location with said primary and secondary tufting in overlying alignment, so that the released cut lengths of yarn are disposed over the two aligned slots; and tufting means positioned adjacent said other side of said stationary bed and disposed in alignment with said primary tufting slot, said tufting means being narrower than the width of said primary tufting slot and being operative to enter said aligned primary and secondary slots, thereby engaging said released cut lengths of yarn and carrying the yarn lengths through the aligned slots and into engagement with said tuft receiving backing material, so that each cut yarn length forms tufts extending outwardly from the backing material.

2. Apparatus as in claim 1, wherein said cutting means comprises:

a first cutting blade mounted in fixed relation to said stationary bed on one side of said yarn dispensing means; and a second cutting blade mounted in movable relation to said stationary bed on the other side of the yarn dispensing means, and disposed in cutting relation with said first cutting blade.

3. Apparatus as in claim 1, further comprising:

means operative to reciprocate said sliding bed along a selectably variable distance between said backward and forward positions, so as to vary the length of the yarn strands withdrawn from the yarn dispensing means by each movement of the sliding bed to the forward posiiton.

4. Apparatus as in claim 1, further comprising means operative to move the tuft receiving material by said primary tufting slot at a selectably variable speed relative to the operation of said tufting means, so as to adjust the density of tufts applied to the backing material.

5. Apparatus as in claim 1, wherein said yarn dispensing means comprises:

a plurality of yarn support bars disposed in closely spaced apart relation to said sliding bed;

each said yarn support bar having a number of yarn feeding passages each of which has an inlet end to receive a selected strand of yarn and an outlet end;

said outlet ends of the yarn feeding passages occupying a first path in parallel alignment with said secondary tufting slot; and displacement means selectably operative to shift at least one of said yarn support bars relative to another of the yarn support bars along said first path;

so that the lengths of yarn cut from the yarn strands fed through said shifted yarn support bar are applied to said tuft receiving backing material laterally displaceed along said first path.

6. Apparatus as in claim 4, further comprising:

movement means selectably operative to displace all of said yarn support bars in unison along a second path substantially perpendicular to said secondary tufting slot, so as to position a selected yarn support bar in yarn feeding relation to said yarn clamp means carried on said sliding bed.

7. Apparatus for producing tufted material, comprising:

a stationary bed;

an elongated primary tufting slot extending through said stationary bed;

means disposed adjacent one side of said stationary bed to support a tuft receiving backing material in proximate relation to said primary tufting slot;

a sliding bed disposed on the other side of said stationary bed, and selectably movable either to a forward position or a backward position relative to the stationary bed;

an elongated secondary tufting slot extending through said sliding bed, said secondary tufting slot being parallel to said primary tufting slot and being in overlying alignment with the primary tufting slot whenever said sliding bed is in said forward position;

yarn dispensing means disposed adjacent said sliding bed and operative to present plural strands of yarn to the sliding bed at a position spaced apart from said forward position;

yarn clamp means carried on said sliding bed and selectably operative at said spaced apart position to engage and hold said yarn strands, so that lengths of the yarn strands are withdrawn from said yarn dispensing means as said sliding bed moves toward said forward position;

cutting means operative in response to movement of said sliding bed toward said forward position to cut off a predetermined length of said withdrawn yarn strands, so that the cut lengths of yarn remain engaged by said clamp means and are carried to the forward position with the sliding bed;

said cutting means comprising a first cutting blade mounted in fixed relation to said stationary bed on one side of said yarn dispensing means; and a second cutting blade mounted in movable relation to said stationary bed on the other side of the yarn dispensing means, and disposed in cutting relation with said first cutting blade;

said second cutting blade being mounted on said sliding bed to be moved into cutting engagement with said first cutting blade as the sliding bed is moved toward said forward position;

said clamp means being operative to release said cut lengths of yarn when said sliding bed is at said forward location with said primary and secondary tufting in overlying alignment, so that the released cut lengths of yarn are disposed over the two aligned slots; and tufting means positioned adjacent said other side of said stationary bed and disposed in alignment with said primary tufting slot, said tufting means being narrower than the width of said primary tufting slot and being operative to enter said aligned primary and secondary slots, thereby engaging said released cut lengths of yarn and carrying the yarn lengths through the aligned slots and into engagement with said tuft receiving backing material, so that each cut yarn length forms tufts extending outwardly from the backing material.

8. Apparatus for producing tufted material, comprising:

a stationary bed;

an elongated primary tufting slot extending through said stationary bed;

means disposed adjacent one side of said stationary bed to support a tuft receiving backing material in proximate relation to said primary tufting slot;

a sliding bed disposed on the other side of said stationary bed, and selectably movable either to a forward position or a backward position relative to the stationary bed;

an elongated secondary tufting slot extending through said sliding bed, said secondary tufting slot being parallel to said primary tufting slot and being in overlying alignment with the primary tufting slot whenever said sliding bed is in said forward position;

yarn dispensing means disposed adjacent said sliding bed and operative to present plural strands of yarn to the sliding bed at a position spaced apart from said forward position;

yarn clamp means carried on said sliding bed and selectably operative at said spaced apart position to engage and hold said yarn strands, so that lengths of the yarn strands are withdrawn from said yarn dispensing means as said sliding bed moves toward said forward position;

said yarn clamp means comprising a first yarn clamping bar carried by said sliding bed and extending along one side of said secondary tufting slot;

a second yarn clamping bar carried by the sliding bed and extending along the other side of the secondary tufting slot; and means operatively associated with one of said yarn clamping bars to selectably move the one yarn clamping bar into clamping engagement with the other yarn clamping bar;

cutting means operative in response to movement of said sliding bed toward said forward position to cut off a predetermined length of said withdrawn yarn strands, so that the cut lengths of yarn remain engaged by said clamp means and are carried to the forward position with the sliding bed;

said clamp means being operative to release said cut lengths of yarn when said sliding bed is at said forward location with said primary and secondary tufting in overlying alignment, so that the released cut lengths of yarn are disposed over the two aligned slots; and tufting means positioned adjacent said other side of said stationary bed and disposed in alignment with said primary tufting slot, said tufting means being narrower than the width of said primary tufting slot and being operative to enter said aligned primary and secondary slots, thereby engaging said released cut lengths of yarn and carrying the yarn lengths through the aligned slots and into engagement with said tuft receiving backing material, so that each cut yarn length forms tufts extending outwardly from the backing material.

9. Apparatus as in claim 8, wherein:

said first yarn clamping bar is stationary with respect to said sliding bed; and said second yarn clamping bar is selectably movable with respect to the slding bed to move across said secondary tufting slot into clamping engagement with the first yarn clamping bar.

10. Apparatus as in claim 9, wherein each of said yarn clamp bars extend outwardly a distance toward said yarn dispensing means, so as to engage and hold said yarn strands.

* * * * *